US005797810A

United States Patent [19]

Sandoval

[11] Patent Number: 5,797,810

[45] Date of Patent: Aug. 25, 1998

[54] BATTING PRACTICE DEVICE

[76] Inventor: George R. Sandoval, 17120 S. Kingsview Ave., Carson, Calif. 90746

[21] Appl. No.: 799,469

[22] Filed: Feb. 13, 1997

Related U.S. Application Data

[63] Continuation of Ser. No. 591,852, Jan. 25, 1996, abandoned.

[51] Int. Cl.[6] ..... A63B 69/00

[52] U.S. Cl. ..... 473/417

[58] Field of Search ..... 473/417, 139, 473/140, 145, 147; 403/2

[56] References Cited

U.S. PATENT DOCUMENTS

| | | | |
|---|---|---|---|
| 1,881,991 | 10/1932 | Yaggi | 473/139 |
| 2,069,650 | 2/1937 | Engh | 473/145 |
| 2,490,409 | 12/1949 | Brown | 473/139 |
| 2,652,250 | 9/1953 | Alder et al. . | |
| 2,713,487 | 7/1955 | Jaediker | 273/29 A |
| 3,788,297 | 1/1974 | Borst | 273/58 C |
| 3,830,504 | 8/1974 | Koo | 473/145 |
| 3,877,697 | 4/1975 | Lersch . | |
| 3,912,404 | 10/1975 | Katt | 403/2 |
| 3,942,794 | 3/1976 | Gowins . | |
| 3,948,517 | 4/1976 | Feiler | 273/29 A |
| 4,417,730 | 11/1983 | Weiner | 273/29 A |
| 4,830,371 | 5/1989 | Lay . | |
| 4,938,478 | 7/1990 | Lay . | |
| 4,976,431 | 12/1990 | Guenther . | |
| 4,989,867 | 2/1991 | Herrick | 273/29 A |
| 4,993,708 | 2/1991 | Prosser et al. . | |
| 5,040,791 | 8/1991 | Ratajac et al. . | |
| 5,203,558 | 4/1993 | An . | |
| 5,386,988 | 2/1995 | Sung et al. . | |
| 5,393,050 | 2/1995 | Lloyd . | |
| 5,419,550 | 5/1995 | Blom | 273/26 E |
| 5,437,590 | 8/1995 | D'Alto . | |
| 5,454,059 | 9/1995 | Weis | 473/139 |

FOREIGN PATENT DOCUMENTS

| | | | |
|---|---|---|---|
| 0253113 | 1/1988 | European Pat. Off. | 273/29 A |
| 2548914 | 1/1985 | France | 273/29 A |
| 4222767 | 1/1994 | Germany | 273/29 A |

*Primary Examiner*—Theatrice Brown

*Attorney, Agent, or Firm*—Fulwider Patton Lee & Utecht, LLP

[57] ABSTRACT

A batting practice device wherein a vertically disposed leaf spring supports a ball securely affixed to its top end. The spring limits movement to a single plane and thereby automatically prevents a batter, standing to one side of the devices, from being struck by the ball or spring upon batting the ball. The use of a leaf spring also provides for a substantial service life.

8 Claims, 1 Drawing Sheet

12
18
20
16
20
2
2
21
25
19
25
26
17
27
29
25
14
3
3
21
21
26
29
27
15

36
54
18
35
52
52
38
46
16
42
50
44
40
48
30
52
52
15
26
34
27
25
29

36
18
54
35
52
38
46
42
50
44
40
48
26
52
52
29
27
34
27
25

BATTING PRACTICE DEVICE

This application is a continuation of application(s) Ser. No. 08/591,852 filed on Jan. 25, 1996 (now ABND).

BACKGROUND OF THE INVENTION

The present invention generally relates to a device for enabling a baseball player to practice batting. More particularly, the invention pertains to a device that automatically returns a ball to its initial position after being struck with a bat.

A plurality of different mechanisms have been devised for enabling a batter to practice striking a ball. Many of these devices employ swinging, rotating, flexing or pivoting arms in combination with springs of various configurations to provide the desired return action. Systems wherein a plurality of components are called upon to interact with one another are naturally more prone to failure than systems with fewer elements. Complexity may also increase the weight and bulk of the device while increasing the cost of manufacture. Relatively simple devices are known but generally fail to adequately control the ball's movement and may cause injury to the batter under certain circumstances.

One previously known device employs a vertically disposed coil spring that supports a ball and exemplifies some of the disadvantages inherent in many of the simpler designs. First and foremost, the plane in which the ball oscillates upon being struck is substantially a function of the angle from which it is struck. Consequently, an improperly delivered blow can cause the ball to be accelerated at an angle such that it recoils in a direction that strikes the batter. This is especially ill-suited for very young batters who may not have the skill or the reflexes to avoid injury. Additionally, while a coil spring is intended to be compressed or extended along its axis, it is not particularly well suited to absorb forces that are directed perpendicular to its axis as is the case in previously known devices. The deflection or distortion of the spring reacting to such a force may be concentrated on a very small section of the spring, e.g. a short length of a single coil. Such distortion may cause the spring to be over-extended at such point thereby causing permanent deformation, and hence rendering the device no longer serviceable.

Additionally it is desirable that the device only take up a minimal amount of space while being stored or transported. In the event disassembly is relied upon to reduce bulk, it is essential that disassembly and assembly of the device can be easily and quickly accomplished.

A simple, safe, inexpensive, tough, and compact device for practicing batting skills is needed that overcomes the disadvantages of the prior art devices.

SUMMARY OF THE INVENTION

The present invention provides a batting practice device that is extremely simple in construction and operation, serves to quickly return the ball to its original position in a safe manner and has a substantial service life. The simplicity of the design minimizes construction costs and enables worn out or broken parts to be quickly and easily replaced. Additionally, the device is easily broken down into a very compact configuration for storage or transportation.

The device of the present invention generally comprises a ball or ball-like element attached to the top of a vertically disposed leaf spring. The bottom end of the spring is securely attached to a base which is anchored to the ground.

The inherent nature of the leaf spring substantially restricts the ball's movement to an arc in a single plane. Tethers serve to quickly arrest the ball's oscillations and steady the ball for the subsequent hit. Additionally, because a leaf spring inherently causes loads, and hence deflections, to be distributed along its entire length and is capable of undergoing a tremendous number of flex cycles, the device is especially tough and has a long service life.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENT

The drawings illustrate the batting practice device of the present invention. The device enables a batter to practice his swing without the repeated interruption otherwise necessitated by retrieving and repositioning the ball. The batter stands to one side of the device to strike the ball. Upon being struck, the ball is initially deflected and immediately returns to its original starting position.

Figure 1:
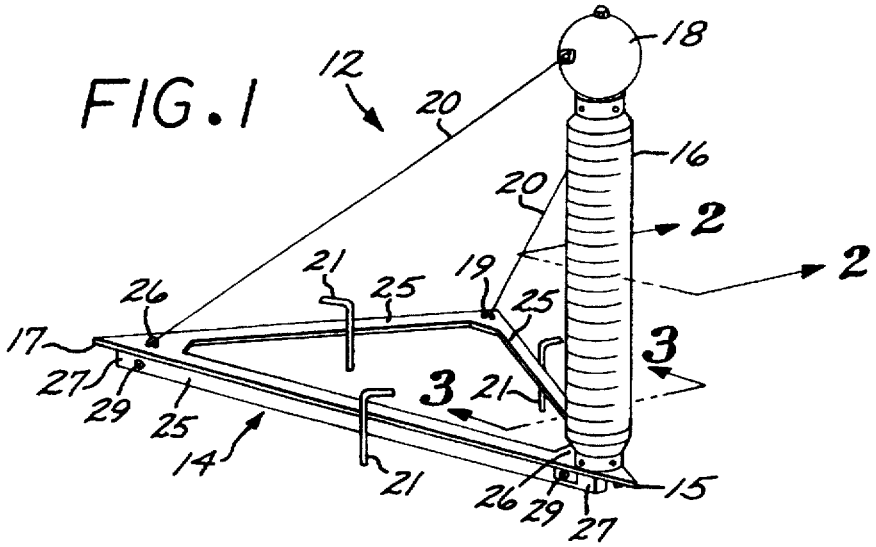
FIG. 1 is a perspective view of the batting practice device of the present invention.

FIG. 1 is a perspective view showing the device 12 of the present invention in its fully assembled state ready for use. A triangular base 14 supports a flexible upright member 16 at one corner 15. The upright member is securely affixed to the base at its bottom end and has a ball 18 securely affixed to its top end. A pair of tether lines 20 interconnect the ball with the opposite corners 17, 19 of the base. Stakes 21 serve to firmly anchor the device upon being driven into the ground.

The base consists of three identical side members 25 and three identical corner members 26. Each side member consists of square cross-section tubing while each of the corner members is configured to both receive the side member ends and to either support the upright member 16 or receive a tether line 20. The corner members 26 have channel brackets 27 attached thereto that surround the end of the side member. A fastener 29 secures the side member within each bracket.

Figure 2:
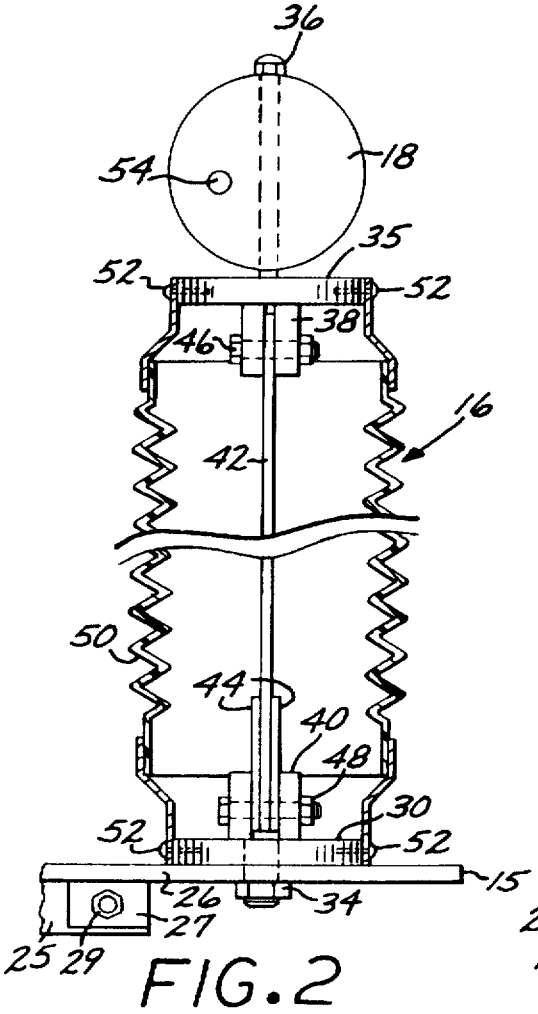
FIG. 2 is an enlarged and sectioned cross-sectional view taken along lines 2—2 of FIG. 1.
Figure 3:
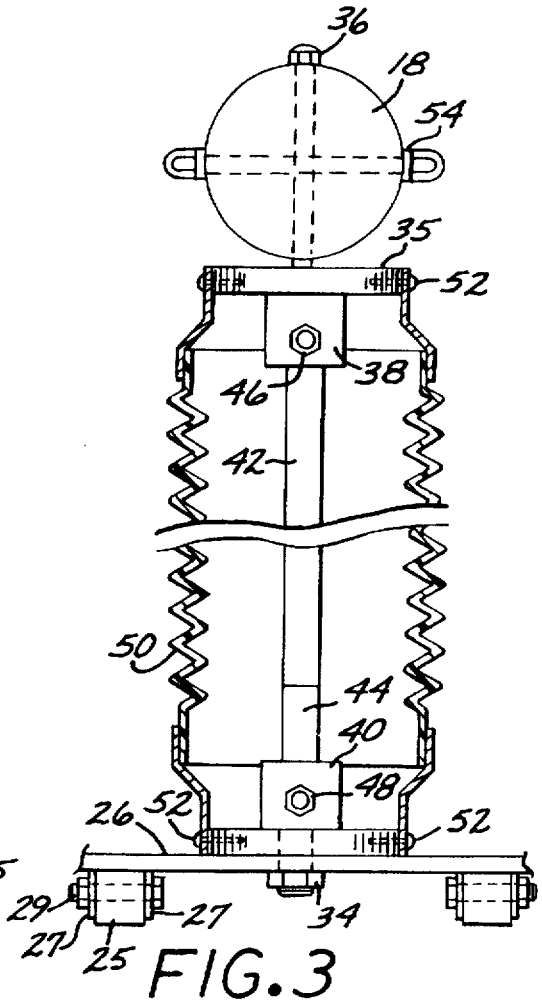
FIG. 3 is an enlarged and sectioned cross-sectional view taken along lines 3—3 of FIG. 1.

FIGS. 2 and 3 illustrate the internal structure of the flexible upright member 16. A base member 30 is attached to a corner bracket 26 via threaded fastener 34 while the ball 18 is affixed to top member 35 via threaded fastener 36. A top 38 and bottom 40 split bracket is affixed to the top and bottom members respective by welding. The ends of leaf spring 42 are captured in the split brackets wherein the bottom end is additionally disposed between two short reinforcement leafs 44. Threaded fasteners 46, 48 serve to securely hold the spring ends in the brackets. A flexible hose 50 such as a vacuum cleaner hose encases the entire assembly and is held in place by fasteners 52 threaded into top and bottom members 35, 30. A rod 54 extends through ball 18 and is configured at its end to receive the tether cords 20.

The spring consists of a leaf of 0.0625" thick, 1.50" wide spring steel, that is approximately 22.50" in length. The strength and resilience of this size of spring has been found ideally suited for use by the 5 to 8 years old age group. The spring is oriented such that the plane defined by its width is parallel to the opposite base member. This substantially restricts movement to a plane that is perpendicular to and bisects the opposite base member regardless of the angle from which the ball is struck to thereby preclude excursions to the side that would allow the ball to strike the batter. The reinforcement leafs 44 near the base of the spring prevent the leaf from being creased over the edge defined by the bottom bracket 30.

The simple structure enables quick assembly and disassembly of the device with the added benefit that the entire device can be warehoused, shipped and stored in a container only 6"×6"×29". Assembly is accomplished by simply inserting the side member 25 ends in channel brackets 27 and fitting fasteners 29. The base member is attached by simply fitting fastener 34 in one of the corner members 26 after which tethers 20 are secured to the opposite corners.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A batting practice device comprising:

a triangular base element;

a vertically oriented, free standing biasing element, rigidly attached at its bottomed to one corner of said base element, said biasing element being exclusively, deformable in a single plane and biased toward maintaining a vertical orientation; and a ball, attached to the top end of said biasing element.

2. The batting practice device of claim 1, wherein said biasing element comprises a leaf spring.

3. The batting practice device of claim 1 wherein said biasing element is oriented such that said plane, in which said biasing element is deformable, is oriented so as to be substantially perpendicular to the side of the triangular base that is positioned opposite the corner from which said biasing element extends.

4. A batting practice device, comprising:

a triangular base element;

a vertically oriented leaf spring attached at its bottom end to a corner of said triangular base, oriented so as to be deformable in a plane substantially perpendicular to the side of the triangular base opposite said corner; and a ball, attached to the top end of the leaf spring.

5. The batting practice device of claim 4 further comprising tethers extending from the ball to the corners of the triangular base opposite to the corner from which the leaf spring extends.

6. A batting practice device comprising:

a triangular base element;

a vertically oriented, free standing biasing element, rigidly attached at its bottomed to one corner of said base element, said biasing element being exclusively, deformable in a single plane and biased toward maintaining a vertical orientation;

a ball, attached to the top end of said biasing element; and a tether extending from said base element and attached to said ball so as to limit said balls movement.

7. The batting practice device of claim 6, wherein said base element is triangular, said biasing element extends upwardly from one of the corners of said triangle and said tether extends from the opposite corners of said triangle.

8. The batting practice device of claim 6, wherein said biasing element comprises a leaf spring.

* * * * *